United States Patent [19]

Nauman

[11] Patent Number: 4,462,824

[45] Date of Patent: Jul. 31, 1984

[54] ANNULAR TUYERE

[75] Inventor: John D. Nauman, Natrona Heights, Pa.

[73] Assignee: Allegheny Ludlum Steel Corporation, Pittsburgh, Pa.

[21] Appl. No.: 504,191

[22] Filed: Jun. 14, 1983

[51] Int. Cl.[3] ..... C21C 5/34
[52] U.S. Cl. ..... 75/60; 75/59
[58] Field of Search ..... 75/59, 60

[56] References Cited

U.S. PATENT DOCUMENTS 3,817,744 6/1974 Leroy ..... 75/60

*Primary Examiner*—Peter D. Rosenberg
*Attorney, Agent, or Firm*—Patrick J. Viccaro

[57] ABSTRACT

An annular tuyere is provided having improved corrosion resistance, particularly at low gas flow rates and useful in the production of metal alloys. The tuyere may have a solid core defining an annulus between the core and an outer tubing. A method is also provided for raising the critical bath temperature at which the tuyere would melt and to minimize the gas flow necessary to cool the tuyere tip.

11 Claims, 4 Drawing Figures

ANNULAR TUYERE

BACKGROUND OF THE INVENTION

This invention relates to a gas-blowing tuyere useful in production of metal alloys. Particularly, this invention relates to a corrosion-resistant tuyere useful at low gas flow rates and a method of blowing which minimizes corroding of the tuyere and minimizes the gas flow necessary to cool the tuyere tip.

In the production of metal alloys of various compositions, such as silicon steels and stainless steels, it is known to employ tuyeres for purposes of injecting gas into the molten metal, such as for deoxidation, decarburization, desulfurization and stirring. Typically, the tuyeres protrude through a refractory lining of a basic oxygen furnace (BOF), ladle or tundish. Usually, a plurality of tuyeres is used in order to insure the proper amount of gas injection into the molten metal to carry out the desired process of decarburization, desulfurization or other. Furthermore, the tuyeres may be located at any location along the sidewalls or bottom of the vessel, though preferably, the tuyeres in the BOF are located adjacent the bottom portion of the vessel. Generally, the tuyere is constructed of a material which is resistant to attack by molten metal and slag at normal operating temperatures.

At a given flow of inert gas, such as argon, through the tuyere, there is a "critical bath temperature" at which the tip of the tuyere reaches the melting point of the material from which the tuyere is made and begins to melt. Below this critical bath temperature, the tip of the tuyere tubing is cooled sufficiently by the flowing gas so that a small amount of molten metal freezes on the tip of the tuyere. Such a frozen layer of metal (also known as "mushroom") is desirable, for it protects the tuyere from attack by the remaining molten metal in the bath while only slightly affecting the gas flow through the tuyere. Above the critical bath temperature,, however, the tuyere melts. The rate of melting is dependent upon several factors, including the temperature of the bath, the gas flow rate and the particular construction of the tuyere.

Attempts at new tuyere designs have been made in order to improve the corrosion resistance of the tuyeres which are subjected to the harsh environment of molten metal baths. One proposed tuyere design comprises an outer metal tube having an inner solid core concentrically spaced within the outer tube and defining a substantially uniform annulus between the core and the outer tube. The inner core consists of a smaller diameter sheath tubing filled with a refractory material. Even such a tuyere has its problems, for it can corrode catastrophically when operated at low gas flow rates, such as less than 150 scfm (4.24 $m^3$/min) and particularly at low gas flow rates per unit area of the tuyere of less than 250 scfm/$in^2$ (0.01 $m^3$/min-$mm^2$) of tuyere annulus area. The corroding and melting of the tuyere becomes particularly acute when high conductivity refractories in the tuyere core and in the lining of the vessel are used. For such reasons, the tuyeres of the prior art have not been used in processes requiring low gas flow rates, and particularly low gas flow rates per unit area of the tuyere annulus, and in designs requiring high conductivity refractories. Furthermore, the prior art does not address tuyere designs which give particular attention to the materials of the tuyere, the construction of the tuyere, the size and gauge of material used in tuyere designs, and the range of minimum to maximum flow rates over which a tuyere is useful.

The abbreviation "scfm" refers to standard cubic feet per minute.

What is needed, therefore, is a tuyere which minimizes excessive corrosion or melting at relatively low gas flow rates, and particularly at low gas flow rates per unit area of the tuyere. Such tuyere designs should also have improved corrosion resistance when high conductivity refractories are used in the tuyere and in the wall lining of a vessel for molten metal. A tuyere and method of blowing gas through the tuyere should have improved cooling of the tuyere tip below its melting point, be useful at low flow rates per unit of area of tuyere and over a wide range of flow rates.

SUMMARY OF THE INVENTION

In accordance with the present invention, a tuyere is provided for flowing gas into a molten metal bath wherein the tuyere comprises a tube being resistant to corrosion attack by molten metal and slag and a means for cooling the tuyere tip adjacent the molten metal bath which raises the critical bath temperature at which the tuyere tip would begin melting. The tuyere includes a means for cooling the tuyere tip adjacent the molten metal bath below its melting point at relatively low gas flow rates through the annulus of less than about 250 scfm/$in^2$ (0.01 $m^3$/min-$mm^2$) of the tuyere annulus area. The means may include an outer tube of the tuyere with a relatively thin wall thickness of less than 0.100 inch (2.5 mm) and an annulus gap of less than 0.062 inch (1.6 mm) between a core and the outer tube. The core may include a sheath tube filled with a refractory material of relatively high conductivity. Furthermore, the sheath tube may be of relatively thin wall thickness of less than about 0.100 inch (2.5 mm).

A method is also provided for blowing gas into the molten metal bath in such a manner that the corroding or melting of the tuyere is minimized. The method includes providing the tuyere with a relatively thin tube wall and a small opening to minimize the melting and corroding of the tuyere tip, monitoring the molten metal bath and adjusting the gas flow as a function of the molten metal bath temperature to minimize the gas flow necessary to cool the tuyere tip. The method may include blowing a gas of relatively high thermal capacity in the excess of 418 J/kg-°C.

The advantage of the present claimed invention is that there is minimal corroding of the tuyere, even with high conductivity refractories at low gas flow rates per unit area. The tuyere and method also are useful over a wider range of flow rates which may be desirable, such as at low flow rates per unit area for silicon steels and slightly higher flow rates per unit area for stainless steels. An advantageous result of the method of the present invention is that the minimum gas flow necessary to maintain a cool tip of the tuyere is at least about one-third less than that necessary in tuyeres of the prior art.

DETAILED DESCRIPTION OF THE PREFERRED EMBODIMENTS

Figure 1:
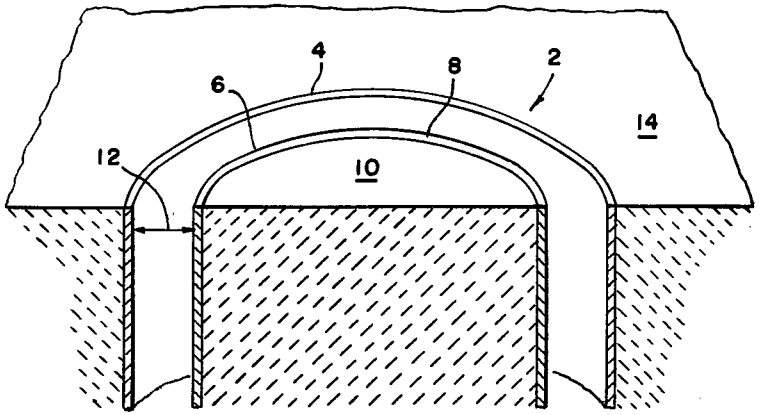
FIG. 1 is a partial cross-sectional view of a tuyere of the present invention.

FIG. 1 discloses a preferred embodiment of the present invention, a tuyere 2 mounted in a refractory lining 14. Tuyere 2 includes an outer tube 4 and an inner solid core 6 concentrically spaced within the outer tube and defining a substantially uniform annulus 12 between the core and the outer tube. Core 6 may include a sheath tube 8 forming the outer surface of the core and filled with a refractory material 10.

The refractory wall 14 of the vessel may be made of any refractory material commonly used in lining vessels for molten metal. It has been found, however, that improved results in the tuyere life result with the tuyere and the method of the present invention when the refractory material has a relatively high thermal conductivity. Typical refractory materials are graphite magnesite and fused magnesite.

The outer tube 4 generally is made of a material which is resistant to corrosion attack by molten metal and slag at normal operating temperatures of the molten metal bath in which the tuyere will be used. Typically, the tube is made of a steel alloy. Preferably, in accordance with the present invention, the material has a high melting point, a high thermal conductivity, and is a low-alloy material, or any combination of these. By providing tube 4 as a low-alloy material, the advantage is the generally higher melting point and greater strength at high temperatures.

Typically, the tuyere, and thus the outside tube 4, has a diameter of about 2 to 4 inches (50.8 to 101.6 mm) and usually about 3 inches (76.2 mm). The length of the tuyere, which is not critical, is usually about 48 inches (1219 mm) and such length is dependent upon the thickness of the lining of the vessel containing the molten metal bath, as well as any protrusion into the vessel, and that necessary for connection to the gas blowing apparatus outside the vessel. What is critical to the present invention is the wall thickness of outside tube 4. It has been found that the wall should be as thin as possible and usually on the order of less than 0.100 inch (2.5 mm), and preferably about 0.062 inch (1.6 mm) or less, and more preferably, less than 0.030 inch (1 mm). A practical limitation on the thinness of the wall is the ability of the tuyere to maintain its shape during fabrication and handling of the tuyere.

Core 6 of tuyere 2 is also a material highly resistant to attack by molten steel and slag and is generally a solid core consisting of a refractory, such as magnesium oxide (MgO). Preferably, core 6 consists of an outer sheath tube 8 made of the same material as outer tube 4 and being filled with a refractory material 10. Preferably for the present invention, the refractory material 10 may have relatively high thermal conductivity in excess of about 1000 $W/m^2$-°C. Examples of such material are graphite-magnesite refractories. Preferably the outer sheath tube 8 has a relatively thin wall thickness of about 0.20 inch (5 mm) or less, and preferably less than 0.15 inch (3.8 mm), and more preferably less than 0.100 inch (2.5 mm). Core 6 must be large enough to define the annular space 12 to the desired size for the desired cooling of the tuyere tip in the molten bath.

Opening or annulus 12, defined between core 6 and outer tubing 4, is generally of a reduced or smaller size than known in the prior art. It has been found that for tuyeres of the size contemplated by the present invention, that an annulus between the core and outer tube of less than 0.062 inch (1.6 mm) is preferred, and may range from 0.020 to 0.080 inch (0.5 to 2.0 mm). By reducing the annulus width or circumference, there results an increase in gas velocity per tuyere to improve cooling of the tuyere tip.

Though with reference to FIG. 1, an opening or annulus 12 is shown between core 6 and outer tube 4, the present invention is not to be limited to that preferred embodiment. As used herein, the term annulus also means a tuyere tip opening wherein there is no core defining a ring-like opening.

What is important in the present invention is not merely the size of the tuyere opening or annulus, but the gas flow rate per unit of the tuyere area. Such a consideration is necessary for it is desirable to have a large tuyere area for high flow rates while also allowing low flow rates from the same tuyere. For example, the gas flow rate through the tuyere can be lowered merely by making the tuyere opening or annulus, if there is one, smaller without any other changes. Such a change, however, does not necessarily result in a reduction in the gas flow rate per unit of tuyere area if other factors, such as pressure, are unchanged, but it will result in an undesirable reduction in the maximum flow rate for the tuyere. Reference to the gas flow rate per unit area better reflects the effectiveness of a tuyere design.

Generally, it has been found that any condition that causes the tip of the tuyere to reach its melting point, whether it be a low gas flow rate, a high bath temperature, or spalling of the surrounding refractory, would contribute to corrosion of the tuyere.

In the course of the investigation in determining improved tuyere designs and methods for blowing gas into molten metal baths, it has been found that the greatest effect on the critical bath temperature is the gas flow rate, the thickness of the outer wall of the tuyere and the size of the opening or width of the annular gap or annulus in the tuyere. It has also been found that the minimum gas flow rate to maintain the tip of the tuyere cooled below its melting temperature is dependent upon numerous variables. Those variables include the furnace or molten metal bath temperature, the width of the annulus, the construction of the tuyere, i.e., such as the outside wall thickness, the materials in the tuyere and their melting point, and the conductivity of the refractory material used in the tuyere and in the vessel lining. As a result of the relationships and functions of the many variables, the critical feature found was that the minimum gas flow rate could be decreased if the thickness of the outside tube in the annular tuyere was decreased. It was also found that the opening, annulus width or circumference of the tuyere could be decreased, as well as the gas flow rate per unit tuyere area and still result in enhanced cooling of the tuyere tip.

Furthermore, it has been found that the critical bath temperature and the gas flow rate per unit area have a direct functional relationship. As the gas flow rate per unit area is increased, the critical bath temperature, i.e., the temperature at which the tuyere begins to melt and corrode, increases. The advantage of raising the critical bath temperature is that the gas flow rate necessary to cool the tuyere tip to avoid corrosion is minimized to lower gas flow rates and an overall total reduction in gas used.

Figure 2:
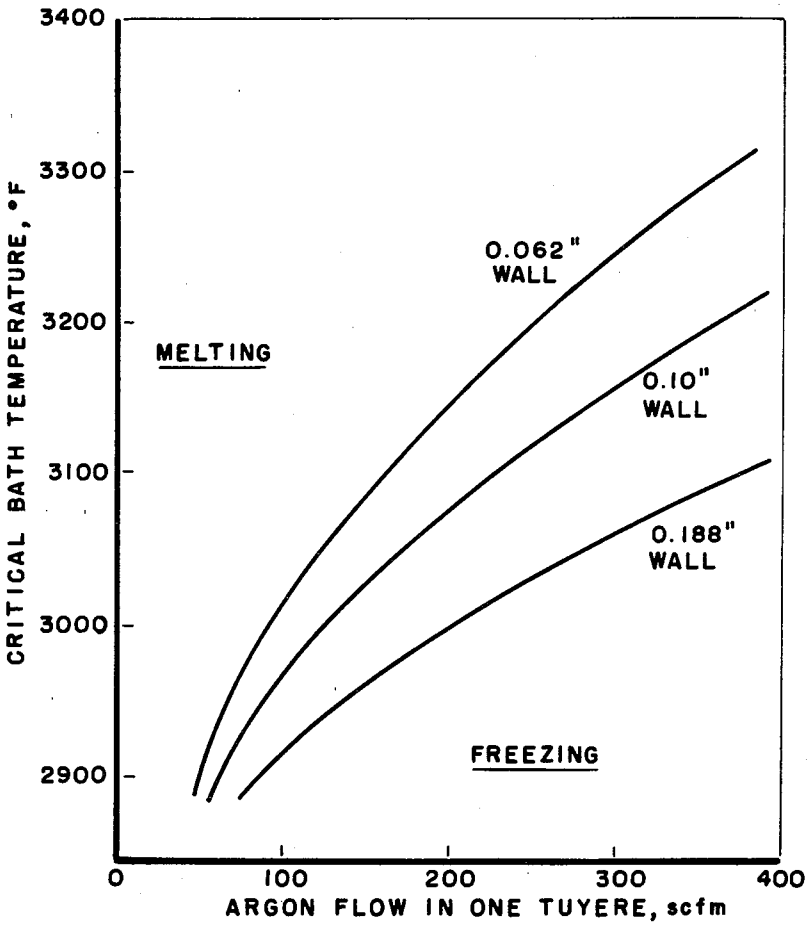
FIG. 2 is a plot of the critical bath temperature versus gas flow for various outer wall thicknesses.
Figure 3:
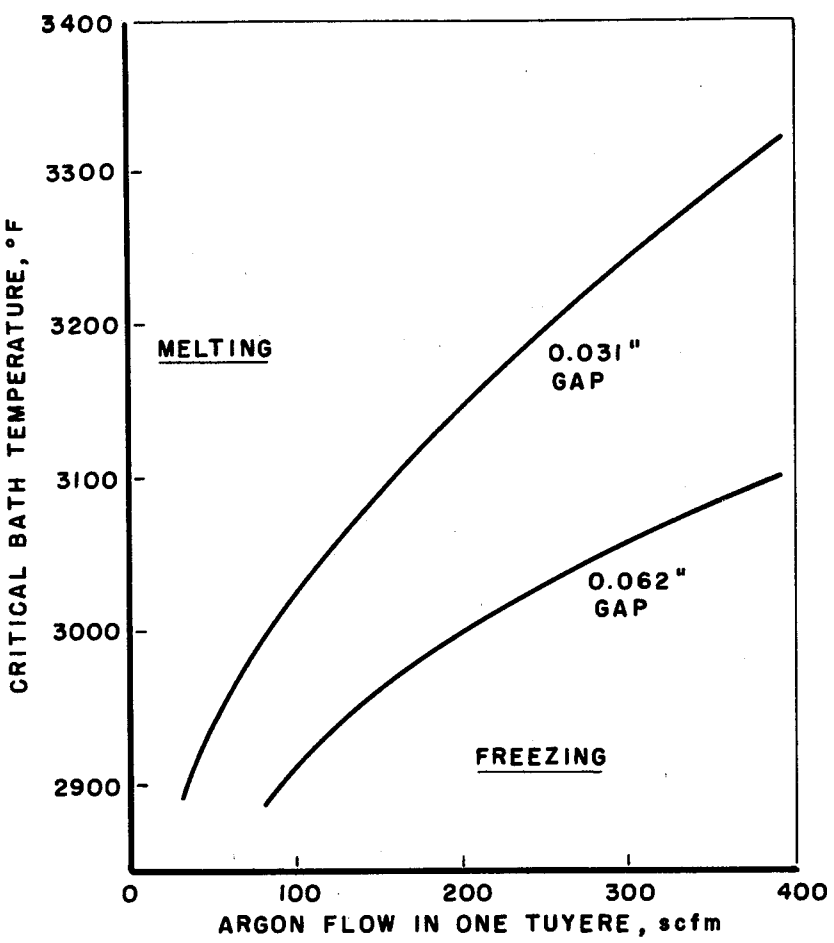
FIG. 3 is a plot of the critical bath temperature versus gas flow for various annulus dimensions.

The effects of the variables on tuyere design were demonstrated by mathematical models. FIGS. 2 and 3 illustrate that the flow rate of gas, the thickness of the outside wall and the area of the tuyere opening (i.e., the width of the annular gap of the tuyere) have the greatest effect on the critical bath temperature. In general, the model was a solution of the temperature distribution in the inside wall 6, outside wall 4, and annular gas as heat flowed from the refractory brick and the liquid bath.

FIG. 2 is a plot of calculated critical bath temperatures for various wall thicknesses and argon flow rates per tuyere. The tuyere design had an inside diameter of outside tube 4 of 3.00 inches (76.2 mm); a central core 6 diameter of 2.88 inches (73.2 mm); an annulus gap 12 of 0.062 inch (1.6 mm). As shown in FIG. 2, at any gas flow rate per tuyere, there is a critical bath temperature at which the tuyere tip would begin to melt. The critical bath temperature increases as the gas flow is increased. For decreasing values of wall thickness of the outside tube 4 of 0.188, 0.10 and 0.062 inch (4.8, 2.5 and 1.6 mm, respectively), the same gas flow rate per tuyere increases the critical bath temperature. In other words, the minimum gas flow necessary to avoid corrosion and melting of the tuyere is reduced. Though there is no intention to be bound by theory, it seems that the thinner outside wall is less exposed to the heat of the molten metal bath, but receives at least the same cooling effect from the gas flow than a thicker wall.

Also for FIG. 2, the gas flow rate per unit area for each curve ranges from about 171 scfm/in$^2$ (0.0075 m$^3$/min-mm$^2$) at about 100 scfm (2.83 m$^3$/min) to about 685 scfm/in$^2$ (0.03 m$^3$/min-mm$^2$) at about 400 scfm (11.3 m$^3$/min) These values are based on a cross-section tuyere area of the annulus of 0.584 square inch. Typically, prior art tuyeres do not operate below 150 scfm (4.25 m$^3$/min) gas flow rate, or about 250 scfm/in$^2$ of annulus area (0.01 m$^3$/min-mm$^3$).

FIG. 3 is a plot of calculated critical bath temperatures for various annular gaps and argon flow rates per tuyere. One tuyere had an inside diameter of outside tube 4 of 2.94 inches (74.7 mm), a central core 6 diameter of 2.88 inches (73.2 mm), an outside wall thickness of 0.156 inch (4 mm), and an annulus gap of 0.031 inch (0.8 mm). The other tuyere is the same as that used for FIG. 2, having a 0.188-inch (4.8 mm) outside wall thickness and 0.062-inch (1.6 mm) annular gap. As shown in FIG. 3, a smaller annulus operates at a higher critical bath temperature for a given flow rate per tuyere. Also shown is the corollary that at a given critical bath temperature, a smaller annulus operates at a lower gas flow rate per tuyere.

Also for FIG. 3, the gas flow rate per unit area for the 0.062-inch curve ranges from about 171 scfm/in$^2$ (0.0075 m$^3$/min-mm$^2$) at about 100 scfm (2.83 m$^3$/min) to about 685 scfm/in$^2$ (0.03 m$^3$/min-mm$^2$) at about 400 scfm (11.3 m$^3$/min). For the 0.031-inch curve, the gas flow rate per unit area ranges from 342 scfm/in$^2$ (0.015 m$^3$/min-mm$^2$) to about 1368 scfm/in$^2$ (0.06 m$^3$/min-mm$^2$) for 100 to 400 scfm, respectively.

Figure 4:
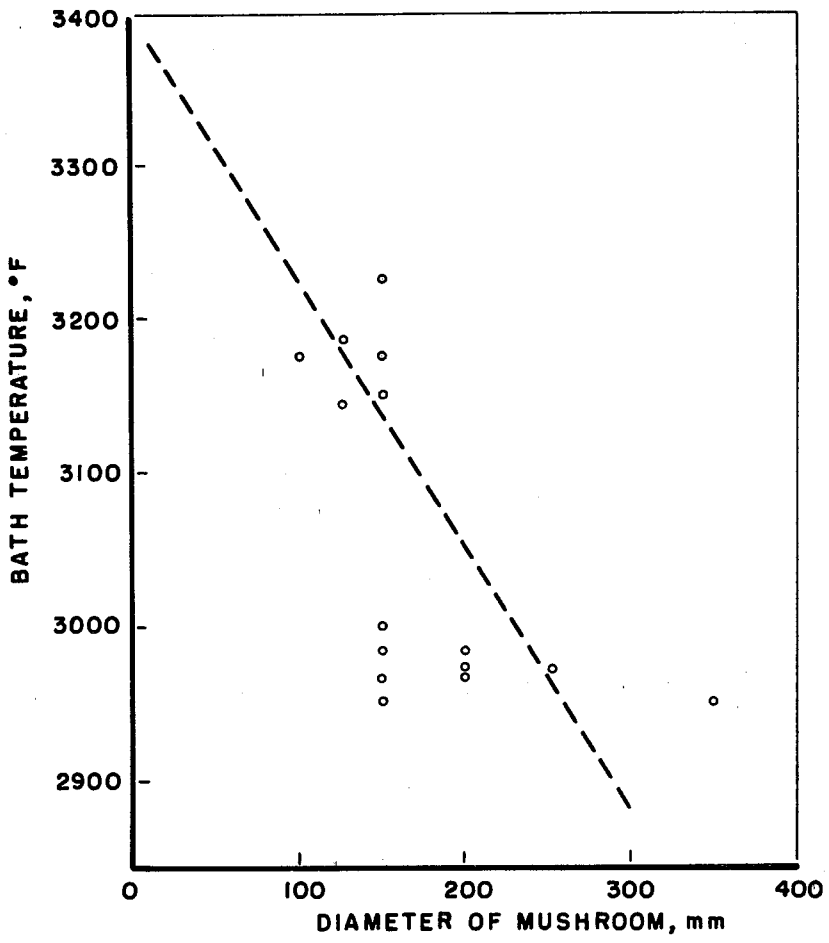
FIG. 4 is a plot of bath temperature versus diameter of frozen metal on the tuyere tip.

FIG. 4 is a plot of bath temperature versus the diameter of the frozen metal on the tuyere tip for fourteen (14) heats of stainless steel refined with three tuyeres having an outside wall thickness of 0.062 inches (1.6 mm) and a gas flow of 400 scfm (11.3 m$^3$/min) per tuyere. The diameter of the "mushroom" was estimated from photographs taken when the vessel was turned down. The diameter is plotted as a function of the bath temperature when the vessel was turned down. FIG. 4 shows that the critical bath temperature (i.e., when the diameter of the mushroom is zero and where tuyere tip corroding and melting would occur) is in excess of 3300° F. (1815° C.). This data conforms well with the mathematical model of FIG. 2. The calculated curve for 0.062 inch outside wall also suggests that the critical bath temperature should be in excess of 3300° F. (1815° C.) for about 400 scfm flow rate. In the actual trials, it was observed that mushrooms were formed in all cases below 3300° F. and that the further the bath temperature was below 3300° F., the larger the diameter of the mushroom formed.

FIGS. 2 and 3 also show the improved range of high to low gas flow rates per tuyere over which the tuyeres of the present invention can be used. The range is broadened by being able to use the tuyeres at relatively lower gas flow rates. FIGS. 2 and 3 both show improvements at lower flow rates by thinner outside walls and a reduced annular gap, respectively, which are illustrated by shifting of the curves toward higher critical bath temperatures and lower flow rates. The broadened range can also be expressed as a ratio of the maximum gas flow rate to minimum gas flow rate at a given critical bath temperature and for a given configuration of tuyeres. For example, in FIGS. 2 and 3, at about 3000° F. critical bath temperature, the usable gas flow rates range from about 200 to 400 scfm (5.7 to 11.3 m$^3$/min) for the 0.188-inch wall (FIG. 2) and 0.062-inch annulus (FIG. 3), respectively. The ratio of maximum-to-minimum gas flow is on the order of 2:1. However, for the tuyere of the present invention having the 0.062-inch (1.6 mm) wall (FIG. 2) and 0.031-inch (0.8 mm) annulus (FIG. 3, the ratio of maximum-to-minimum gas flow is on the order of 4:1 for gas flow rates ranging from about 100 scfm (5.7 m$^3$/min) or less to about 400 scfm (11.3 m$^3$/min).

Though the FIG. 3 illustrates the benefits of operating with a smaller annulus, making the annulus smaller without other changes and features of the present invention has its drawbacks. Decreasing the annulus alone does not decrease the gas flow per unit area and would require higher gas pressures. Though there is an improved cooling of the tuyere, the range of maximum-to-minimum flow rate is sacrificed. The benefit of providing a thinner outer wall of the tuyere improves the flow rate per unit area of the tuyere and thus widens the usable range of the tuyere.

In accordance with the present invention, the tuyere structure and method of using the tuyere for blowing gas includes several other features. By providing a thinner wall for outside tube 4, and a smaller annular gap, modified tuyeres can be used in existing vessels without further modifications, such as to gas pressure. If additional or increased gas pressure is available, the efficiency of the tuyere design of the present invention and method of using can result in further improvement in the tuyere life. It is also anticipated that the critical bath temperature could be further increased by using a higher melting point alloy for the tuyere materials, or a gas with a greater capacity for heat. For example, a low-carbon, low-alloy steel tuyere theoretically could increase the critical bath temperature by about 18° F. over that for regular carbon steel without melting the tuyere. Furthermore, use of nitrogen or carbon dioxide, for example, could be substituted in whole or part for argon and could increase the allowable bath temperature by about 40°-50° F. Argon has a thermal capacity of about 418 J/kg-°C.

In using the tuyere of the present invention, a preferred method may also improve tuyere life as well as provide other advantages. The method includes the steps of raising the critical bath temperature by providing the tuyere with a relatively thin outer wall and a relatively small annular gap, monitoring the molten metal bath temperature and adjusting the gas flow as a function of the molten metal bath temperature to minimize the gas flow necessary to cool the tuyere tip. Generally, the molten metal bath of a steel alloy may range from 2500° to 3300° F. (1371° to 1800° C.). After a critical operating temperature curve is established for a particular tuyere, it is preferred that the operator attempt to maintain and adjust the gas flow through the tuyere as close to the curve as possible and following the curve to maintain the frozen metal layer or mushroom. The gas flow should be low as the bath temperature is low and increased as the bath temperature is increased. Such a method not only minimizes corroding of the tuyere and prolongs its life, but also minimizes the gas necessary for the production process. Such economic considerations provide reduced costs in producing the metal.

While several embodiments of the invention have been shown and described, it will be apparent to those skilled in the art that modifications may be made therein without departing from the scope of the present invention. The present invention could be incorporated in decarburization, desulfurization and stirring processes as an efficient way of economically providing the total amount of gas necessary to carry out the process. Furthermore, though a steel melt or bath is referred to, the invention is equally useful in molten baths of other metals.

What is claimed is:

1. An annular tuyere for flowing a gas into a molten metal bath comprising:

a tube being resistant to corrosive attack by molten metal and slag, wherein the gas flowing through the tube also cools the tip of the tuyere tube adjacent the molten metal; and means for further cooling of the tuyere tip adjacent the molten metal bath to have the effect of raising the critical bath temperature at which the tuyere tip would begin melting at gas flow rates through the tuyere of about 250 scfm/in$^2$ of the tuyere area of less, said means includes a relatively thin tube wall thickness of less than 0.100 inch.

2. The tuyere as set forth in claim 1 wherein said tube is an outer tube, and further comprising an inner solid core concentrically spaced within the outer tube and defining a substantially uniform annulus between the core and outer tube.

3. The tuyere as set forth in claim 2 wherein the tube has a diameter of about 2 to 4 inches and an annulus between the core and outer tube of less than 0.062 inch.

4. The tuyere as set forth in claim 2 wherein the core has an outer sheath tube and refractory material, the sheath tube being of low-alloy steel having a relatively thin wall thickness and forming the outer surface of the core and the sheath tube being filled with the refractory material of relatively high conductivity.

5. The tuyere as set forth in claim 1 or 2 wherein the tube is a low-alloy material having a relatively high melting point.

6. The tuyere as set forth in claim 1 or 2 wherein the means for cooling the tuyere includes a relatively thin tube having a wall thickness suitable to maintain its shape during handling.

7. The tuyere as set forth in claim 1 or 2 wherein the range of usable gas flow rates has a ratio of maximum to minimum gas flow of greater than about 2:1.

8. The tuyere as set forth in claim 1 wherein the means for cooling includes a relatively thin tube for improved heat transfer and a relatively small annulus.

9. An annular tuyere for flowing a gas into a molten metal bath comprising:

a metal tube being resistant to corrosion attack by molten metal and slag and having a relatively high melting point, the tube having a wall thickness of less than 0.100 inch and a relatively small annulus of less than 0.062 inch for cooling of the tuyere tip adjacent the molten metal bath below its melting point at relatively low gas flow rates through the annulus of less than about 250 scfm/in$^2$.

10. An annular tuyere for flowing a gas into a molten metal bath, said tuyere characterized by improved corrosion resistance at low gas flow rates and having a ratio of maximum to minimum flow rates of greater than 2:1, said tuyere comprising:

an outer tube of low-alloy steel having a relatively high melting point, said tube having a diameter of about 2 to 4 inches and a relatively thin wall thickness of less than about 0.100 inch; and an inner solid core concentrically spaced within the outer tube and defining a substantially uniform annulus between the core and outer tube of less than about 0.062 inch;

said core having a sheath tube and refractory material, the sheath tube being of low-alloy steel having a relatively thin wall thickness of less than 0.20 inch and forming the outer surface of the core and the sheath tube being filled with the refractory material of relatively high conductivity.

11. The tuyere as set forth in claim 10 wherein the tube has a wall thickness of about 0.062 inch or less, and an annulus of about 0.031 inch and the tuyere is characterized by a ratio of maximum to minimum flow rates of about 4:1 or more.

* * * * *